US009964080B2

(12) United States Patent
Zhang

(10) Patent No.: US 9,964,080 B2
(45) Date of Patent: May 8, 2018

(54) METHOD AND SYSTEM FOR VACUUM GENERATION USING A THROTTLE

(71) Applicant: Ford Global Technologies, LLC, Dearborn, MI (US)

(72) Inventor: Xiaogang Zhang, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days. days.

(21) Appl. No.: 15/247,492

(22) Filed: Aug. 25, 2016

(65) Prior Publication Data

US 2018/0058402 A1 Mar. 1, 2018

(51) Int. Cl.

| | |
|---|---|
| ***F02D 9/08*** | (2006.01) |
| ***F02M 37/02*** | (2006.01) |
| ***F02D 9/10*** | (2006.01) |
| ***F02M 25/08*** | (2006.01) |
| ***F02M 33/02*** | (2006.01) |

(52) U.S. Cl.

CPC ..... *F02M 37/025* (2013.01); *F02D 9/1005* (2013.01); *F02D 9/1055* (2013.01); *F02M 25/0836* (2013.01); *F02M 33/02* (2013.01)

(58) Field of Classification Search

CPC ..... F02D 9/08; F02D 9/1005; F02D 9/101; F02M 37/025

USPC ..... 123/337

See application file for complete search history.

(56) References Cited

U.S. PATENT DOCUMENTS

| | | | | |
|---|---|---|---|---|
| 4,584,981 | A | 4/1986 | Tanabe et al. | |
| 4,870,857 | A | 10/1989 | Smith | |
| 5,515,674 | A | 5/1996 | Kaufmann, Jr. | |
| 7,886,727 | B2 | 2/2011 | Ulrey et al. | |
| 8,181,453 | B2 | 5/2012 | Goplen et al. | |
| 8,261,716 | B2 | 9/2012 | Bergbauer et al. | |
| 8,353,266 | B2 | 1/2013 | White et al. | |
| 9,022,077 | B2 | 5/2015 | Statler, III et al. | |
| 9,027,536 | B2 | 5/2015 | Pursifull et al. | |
| 9,243,595 | B2 | 1/2016 | Euliss et al. | |
| 9,388,746 | B2 | 7/2016 | Russ | |
| 2003/0111065 | A1 | 6/2003 | Blum | |
| 2005/0092944 | A1 | 5/2005 | Patterson | |
| 2007/0236083 | A1* | 10/2007 | Kawamori | B60T 13/52 303/114.3 |
| 2011/0100325 | A1* | 5/2011 | Wu | F02D 9/1055 123/337 |
| 2015/0285160 | A1 | 10/2015 | Zhang | |
| 2016/0061160 | A1* | 3/2016 | Fletcher | F02M 35/10229 417/159 |

FOREIGN PATENT DOCUMENTS

| | | | | |
|---|---|---|---|---|
| CN | 101216118 | A | 7/2008 | |
| DE | 19612230 | A1 * | 10/1997 | F02D 9/101 |
| EP | 1469258 | A | 10/2004 | |

OTHER PUBLICATIONS

Zhang, Xiaogang, "Method and System for Vacuum Generation Using a Throttle Comprising a Hollow Passage," U.S. Appl. No. 14/707,882, filed May 8, 2015, 54 pages.

* cited by examiner

*Primary Examiner* — Mahmoud Gimie
(74) *Attorney, Agent, or Firm* — Julia Voutyras; McCoy Russell LLP

(57) ABSTRACT

Methods and systems are provided for a throttle plate and a vacuum consumption device. In one example, a method may include providing vacuum to a vacuum consumption device with a venturi passage inside a throttle.

19 Claims, 6 Drawing Sheets

METHOD AND SYSTEM FOR VACUUM GENERATION USING A THROTTLE

FIELD

The present description relates generally to vacuum generation in an intake via a throttle plate.

BACKGROUND/SUMMARY

Vehicle systems may include various vacuum consumption devices that are actuated using vacuum. These may include, for example, a brake booster and a purge canister. Vacuum used by these devices may be provided by a dedicated vacuum pump. In other embodiments, one or more aspirators (alternatively referred to as ejectors, venturi pumps, jet pumps, and eductors) may be coupled in the engine system that may harness engine airflow and use it to generate vacuum.

In yet another example embodiment shown by Bergbauer et al. in U.S. Pat. No. 8,261,716, a control bore is located in the wall of the intake such that when the throttle plate is at idle position, vacuum generated at the periphery of the throttle is used for a vacuum consumption device. Therein, the positioning of the throttle plate in an idle position provides a constriction at the throttle plate's periphery. The increasing flow of intake air through the constriction results in a venturi effect that generates a partial vacuum. The control bore is sited so as to utilize the partial vacuum for a vacuum consumption device.

The inventors herein have identified potential issues with the above approach. As an example, the vacuum generation potential of the throttle is limited. For example, a single control bore at one location in the intake, as shown in U.S. Pat. No. 8,261,716, is utilized by the vacuum consumption device even though vacuum may be generated at the entire periphery of the throttle. To use vacuum generated at the entire periphery of the throttle, more control bores may be needed in the intake passage. However, fabricating these control bores may result in significant modifications to the design of the intake passage which can increase related expenses.

In the approaches that use one or more aspirators to generate vacuum, additional expenses may be incurred because of individual parts that form the aspirator including nozzles, mixing and diffusion sections, and check valves. Further, at idle or low load conditions, it may be difficult to control the total air flow rate into the intake manifold since the flow rate is a combination of leakage flow from the throttle and airflow from the aspirator. Typically, an aspirator shut off valve (ASOV) may be included along with the aspirator to control airflow but with added cost. Further, installing aspirators in the intake can lead to constraints on space availability as well as packaging issues.

In one example, the issues described above may be addressed a system comprising a throttle valve have a venturi passage located inside its throttle body, the venturi passage configured to receive intake air directly from an intake passage when the venturi passage is parallel to a direction of incoming intake air flow. In this way, motive air may flow through venturi passages formed between the throttle plate and an exhaust pipe, or through the venturi passage in the throttle plate dependent on a position of the throttle plate.

As one example, edges of the throttle plate are beveled or curved such that constricted passages (e.g., venturi passages) are formed between the edges and an intake pipe. This may occur in a more closed position of the throttle plate. As such, motive flow through the venturi passages adjacent the exhaust pipe may generate vacuum to be supplied to a vacuum consumption device. The throttle plate comprises one or more venturi passages located inside the throttle plate and configured to admit motive air therethrough. As such, motive air may flow through the venturi passage(s) inside the throttle plate and generate vacuum to be supplied to the vacuum consumption device. By doing this, vacuum may be provided to the vacuum consumption device through a plurality of positions of the throttle plate.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-6C are shown approximately to scale.

DETAILED DESCRIPTION

Figure 1:
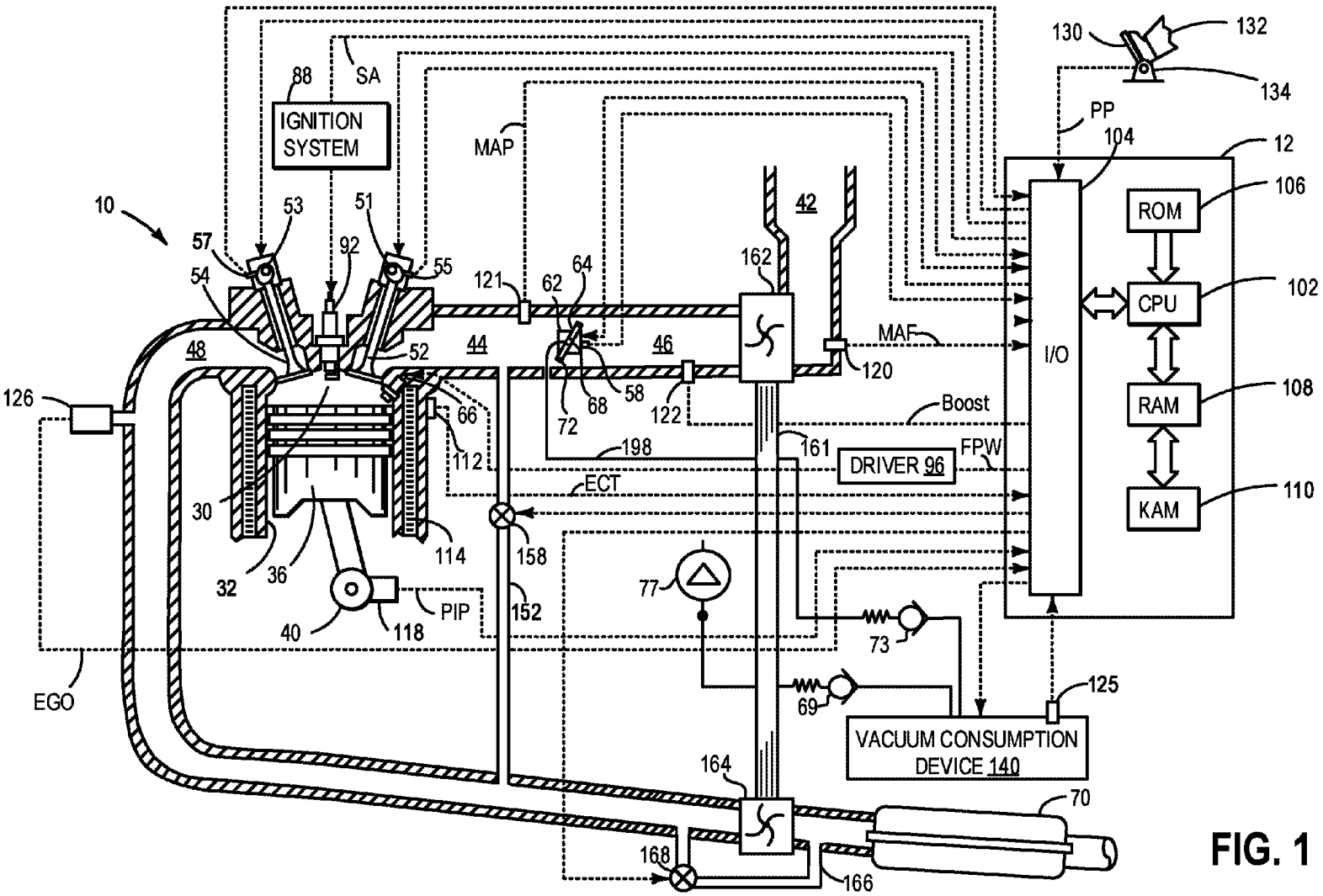
FIG. 1 portrays a schematic diagram of an engine in accordance with the present disclosure.
Figure 2:
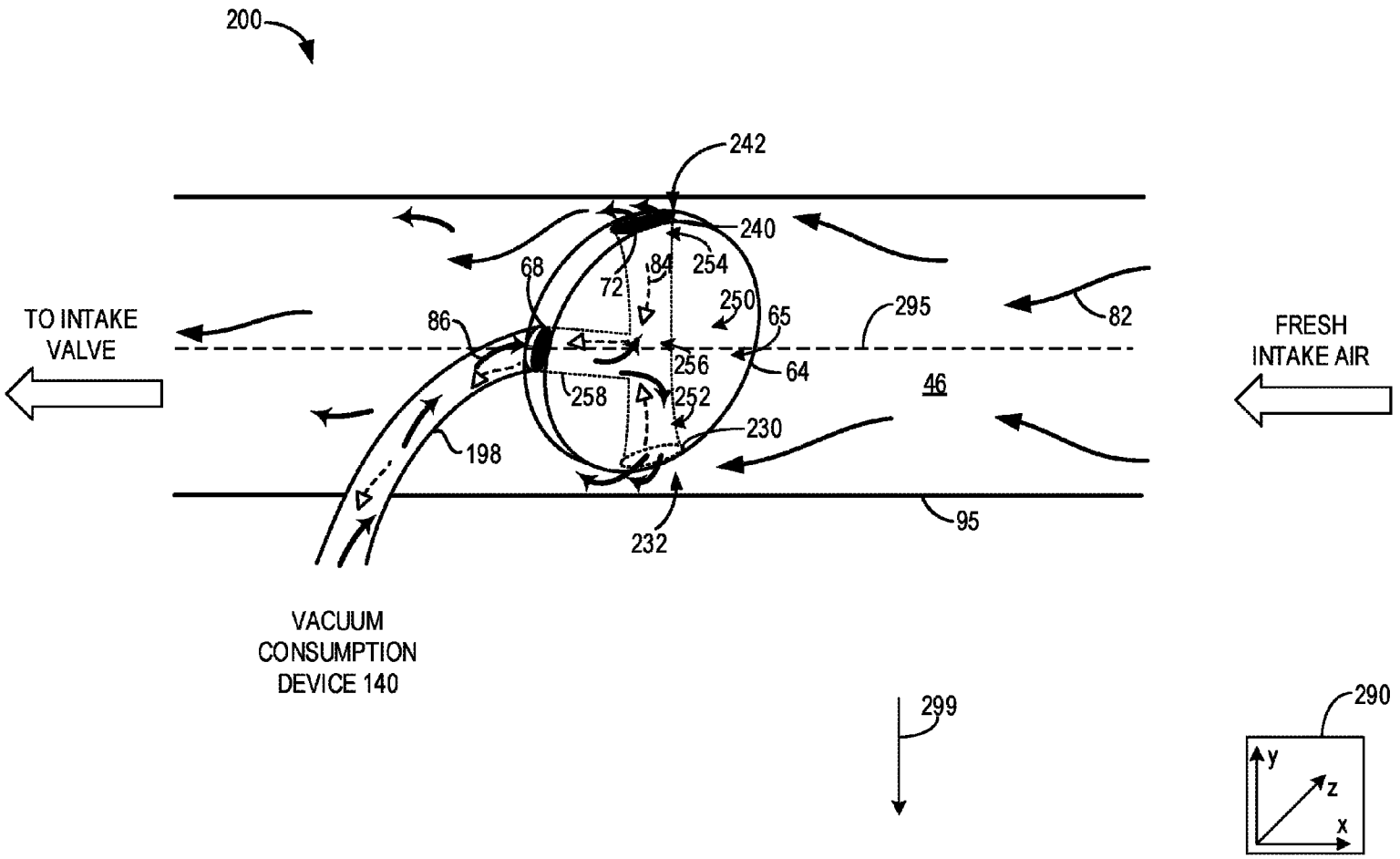
FIG. 2 depicts an example embodiment of an intake throttle plate with a venturi passage located therein.
Figure 3:
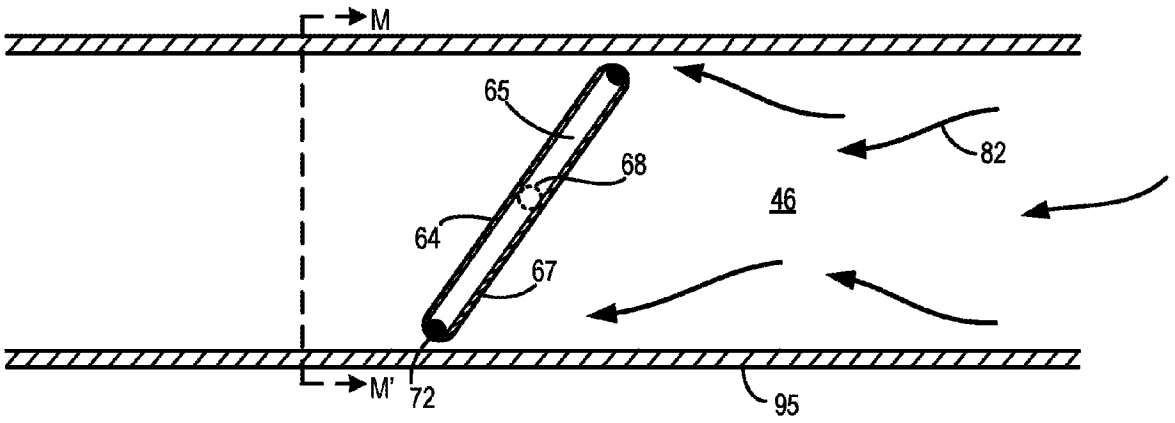
FIG. 3 is a schematic illustration of the throttle plate of FIG. 2 within the intake passage.
Figure 4:
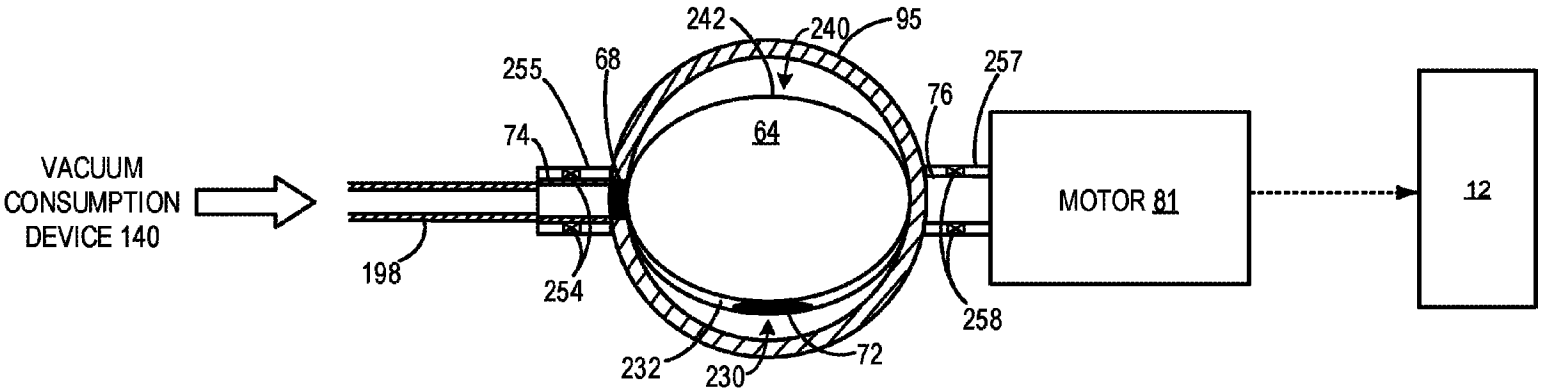
FIG. 4 shows a cross-section of the intake passage of FIG. 3 to depict an alternate view of the hollow throttle plate.
Figure 5:
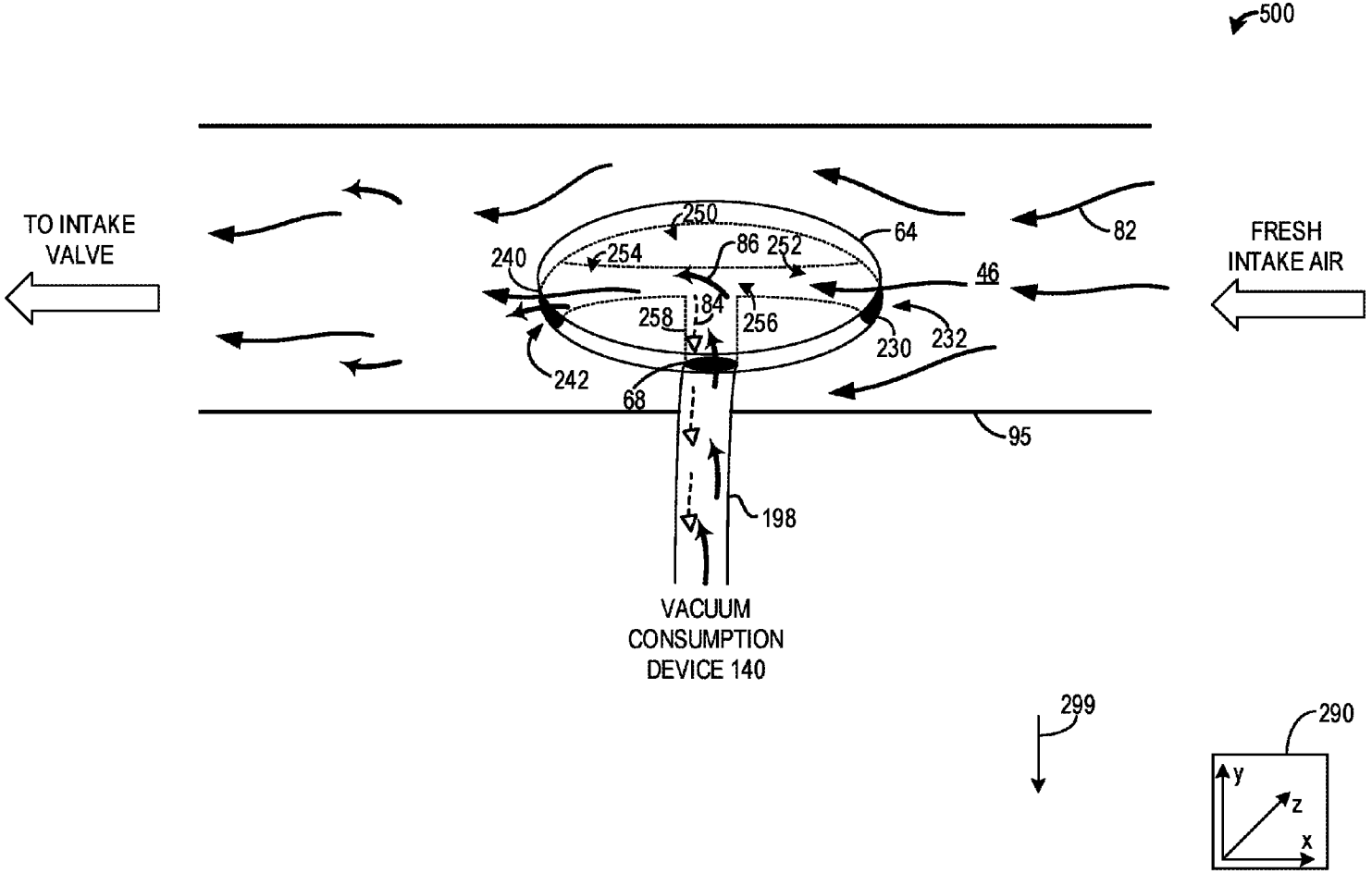
FIG. 5 shows an alternate position of the intake throttle plate with the venturi passage.
Figure 6C:
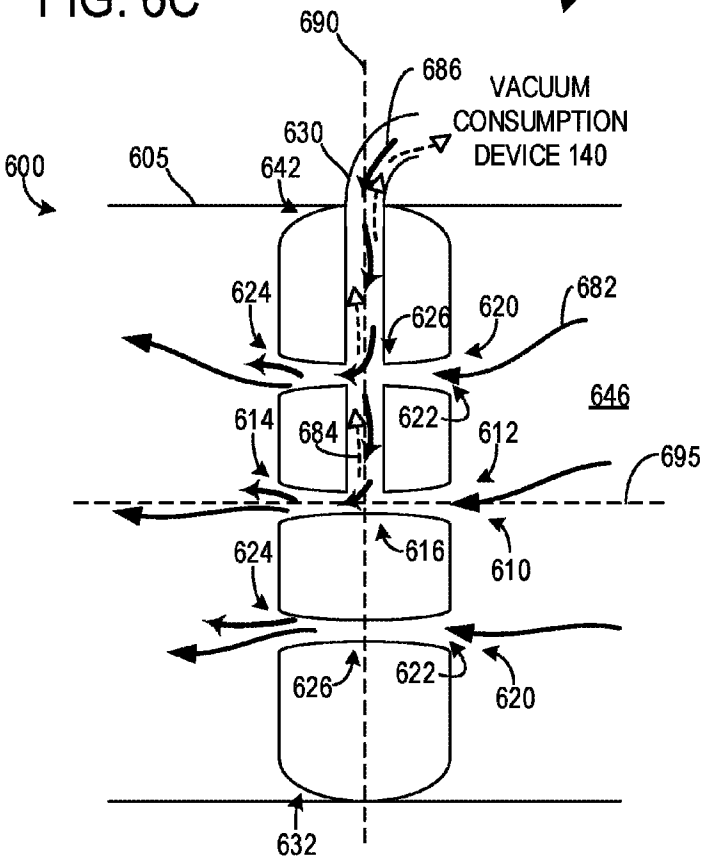
FIG. 6C shows a cross-section of the intake throttle plate comprising annular venturi passages in a more closed position along with an example intake air flow.
Figure 6A:
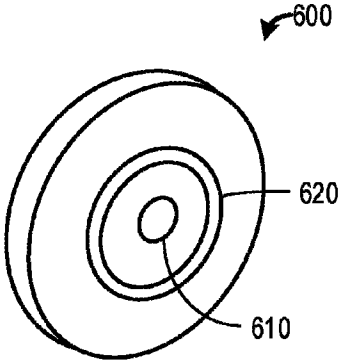
FIG. 6A shows an isometric view of a second example embodiment of an intake throttle plate comprising annular venturi passages.
Figure 6B:
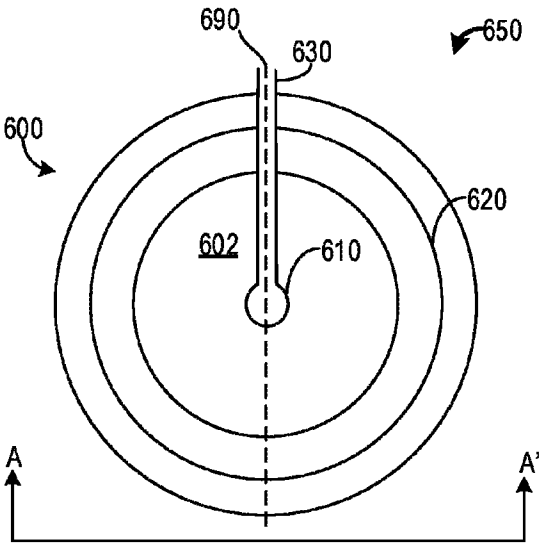
FIG. 6B shows a face-on view of the second example embodiment of the intake throttle plate comprising annular venturi passages.
Figure 7:
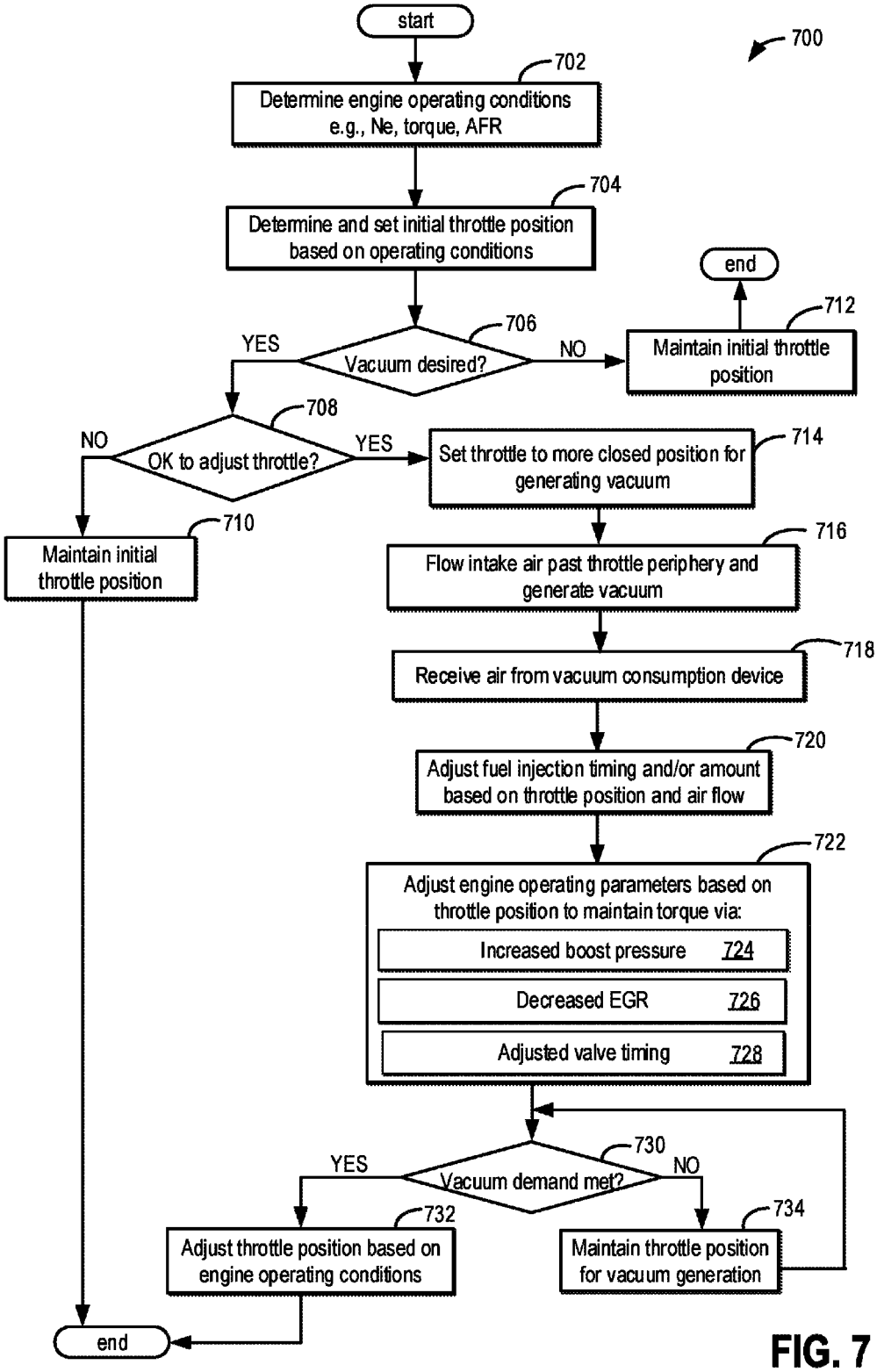
FIG. 7 is a flowchart illustrating an example method for adjusting throttle position and engine operating parameters.

The following description relates to systems and methods for generating vacuum within an intake passage in an engine, such as the engine system shown in FIG. 1. The intake passage may be provided with an intake throttle comprising a throttle plate with a perforated edge coupled to a vacuum consumption device via a hollow shaft, as shown in FIGS. 2-4. The intake throttle may be actuated to various positions. FIG. 2 shows the intake throttle in a more closed position, whereas FIG. 5 shows the intake throttle in a more open position. A second embodiment of the throttle plate is shown in FIGS. 6A, 6B, and 6C. The second embodiment includes annular venturi passages fluidly coupled to a vacuum consumption device. A controller may be configured to perform a routine to modify a throttle position based on vacuum demand from the vacuum consumption device (FIG. 7).

FIGS. 1-6C show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Referring now to FIG. 1, it shows a schematic depiction of a spark ignition internal combustion engine 10. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Combustion chamber 30 (also known as, cylinder 30) of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel (not shown) to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to the pulse width of signal FPW received from controller 12 via electronic driver 96. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake manifold 44 in a configuration that provides what is known as port injection of fuel into the intake port upstream of combustion chamber 30.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Engine 10 may further include a compression device such as a turbocharger or supercharger including at least a compressor 162 arranged along intake passage 42. For a turbocharger, compressor 162 may be at least partially driven by a turbine 164 (e.g., via a shaft) arranged along exhaust passage 48. Compressor 162 draws air from intake passage 42 to supply boost chamber 46. Exhaust gases spin turbine 164 which is coupled to compressor 162 via shaft 161. For a supercharger, compressor 162 may be at least partially driven by the engine and/or an electric machine, and may not include a turbine. Thus, the amount of compression provided to one or more cylinders of the engine via a turbocharger or supercharger may be varied by controller 12.

A wastegate 168 may be coupled across turbine 164 in a turbocharger. Specifically, wastegate 168 may be included in a bypass 166 coupled between an inlet and outlet of the exhaust turbine 164. By adjusting a position of wastegate 168, an amount of boost provided by the turbine may be controlled.

Intake manifold 44 is shown communicating with throttle 62 having a throttle plate 64. In this particular example, the position of throttle plate 64 may be varied by controller 12 via a signal provided to an electric motor or actuator (not shown in FIG. 1) included with throttle 62, a configuration that is commonly referred to as electronic throttle control (ETC). Throttle position may be varied by the electric motor via a shaft. As elaborated at FIG. 2-4, throttle plate 64 may be at least partially hollow and may include an opening 68 which fluidically couples the throttle with vacuum consumption device 140. Throttle 62 may control airflow from intake boost chamber 46 to intake manifold 44 and combustion chamber 30 among other engine cylinders. The position of throttle plate 64 may be provided to controller 12 by throttle position signal TP from throttle position sensor 58.

Engine 10 is coupled to vacuum consumption device 140 which may include, as non-limiting examples, one of a brake booster, a fuel vapor canister, and a vacuum-actuated valve (such as a vacuum-actuated wastegate and/or EGR valve). Vacuum consumption device 140 may receive vacuum from a plurality of vacuum sources. One source may be vacuum pump 77 that may be selectively operated via a control signal from controller 12 to supply vacuum to vacuum consumption device 140. Check valve 69 allows air to flow to vacuum pump 77 from vacuum consumption device 140 and limits airflow to vacuum consumption device 140 from vacuum pump 77. Another source of vacuum may be throttle plate 64 which is positioned within boost chamber 46. Throttle plate 64 has multiple perforations at its periphery, in one example.

As shown in FIG. 1, an opening 68 within throttle plate 64 may be connected to vacuum consumption device 140 via a hollow shaft mounted on bearings (not shown) and coupled to a conduit 198. When throttle plate 64 is in a mostly closed or a fully closed position, vacuum may be generated at the periphery of throttle plate 64 as intake air flows past the edge. This vacuum may draw air from vacuum consumption device 140 through conduit 198, via the hollow shaft into opening 68 of throttle plate 64. This air may then flow out of openings at the periphery of throttle plate 64. Check valve 73 ensures that air flows from vacuum consumption device 140 to throttle plate 64 and thereon into intake manifold 44 and not from intake manifold 44 to vacuum consumption device 140.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof.

An exhaust gas recirculation (EGR) system may be used to route a desired portion of exhaust gas from exhaust passage 48 to intake manifold 44 through conduit 152 via EGR valve 158. Alternatively, a portion of combustion gases may be retained in the combustion chambers, as internal EGR, by controlling the timing of exhaust and intake valves.

Controller 12 is shown in FIG. 1 as a conventional microcomputer including: microprocessor unit 102, input/output ports 104, read-only memory 106, random access memory 108, keep alive memory 110, and a conventional data bus. Controller 12 commands various actuators such as throttle plate 64, EGR valve 158, and the like. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by vehicle operator 132; a measurement of engine manifold pressure (MAP) from pressure sensor 121 coupled to intake manifold 44; a measurement of boost pressure from pressure sensor 122 coupled to boost chamber 46; a measurement of vacuum in vacuum consumption device 140 from pressure sensor 125, a profile ignition pickup signal (PIP) from Hall effect sensor 118 (or other type) coupled to crankshaft 40; a measurement of air mass entering the engine from mass airflow sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

The controller 12 receives signals from the various sensors of FIG. 1 and employs the various actuators of FIG. 1 to adjust engine operation based on the received signals and instructions stored on a memory of the controller. For example, adjusting the throttle plate may include adjusting an actuator of the throttle plate to adjust a position of the throttle plate. As an example, the actuator may be signaled to move the throttle plate to a more open position in response to a tip-in (e.g., accelerator pedal 130 in a more depressed position).

As described above, FIG. 1 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key in the ignition switch on the steering column, for example. The starter is disengaged after engine start, for example, by engine 10 reaching a predetermined speed after a predetermined time.

FIG. 2 illustrates a schematic diagram of an embodiment 200 of a throttle plate, coupled to a vacuum consumption device that may be included in the intake of engine 10 of FIG. 1. As such, components previously introduced in FIG. 1 are numbered similarly in FIG. 2 and not reintroduced. An axis system 290 comprising three axes, namely, an x-axis parallel to a horizontal direction, a y-axis parallel to a vertical direction, and a z-axis perpendicular to both the horizontal and vertical directions. A direction of gravity is shown by arrow 299.

A central axis 295 of the intake conduit 95 is shown. A direction of incoming intake air (fresh intake air arrow) is parallel to the central axis 295. The throttle plate 64 may pivot about the central axis 295. In this way, a venturi passage 250 inside the throttle plate 64 may become parallel to the central axis 295 or perpendicular to the central axis 295, as shown.

Throttle plate 64 is shown positioned within boost chamber 46 of an intake as fresh intake air 82 flows through intake conduit 95. Vacuum consumption device 140 is fluidly coupled via conduit 198 to a hollow shaft (not shown), which in turn is connected to opening 68 of throttle plate 64. The hollow shaft may be mounted on bearings coupled to an inner or outer surface of intake conduit 95. Throttle plate 64 may be partially hollow and includes first and second openings 230 and 240 at its periphery, opposite one another and approximately 90° away from opening 68. That is, the first and second openings 230 and 240 may be arranged along a circumference of the throttle plate 64. In one example, the first and second openings 230 and 240 may have a width that is less than the width of the throttle plate 64 along the z-axis. In an alternate example, where the throttle is shaped such that it narrows when going from the center of the throttle towards the edge (that is, a width of the throttle plate at the center is wider than a width of the throttle plate at the edge), the first and second openings 230 and 240 may have a width based on the width of the throttle at the edge. Further, the first and second openings 230 and 240 may be substantially identical in shape and size. Alternatively, the first and second openings 230 and 240 may be different in shape and/or size. For example, both the first and second openings 230 and 240 are oblong. However, it will be appreciated that one of the openings may be oblong and the other rectangular without departing from the scope of the present disclosure.

In the given example, the first and second openings 230 and 240 are located at two diametrically opposite locations along the edge of the throttle plate 64. Specifically, in the example shown, the second opening 240 is located at a first location at a top edge 242 and the first opening 230 is located at a second location, diametrically opposite the first location, at a bottom edge 232 of throttle plate 64. In the depicted example, each of the first and second openings 230 and 240 is a single opening. Alternatively, the first and second openings 230 and 240 may be a plurality of smaller openings (e.g., a cluster of perforations). Additionally, the edge surface of throttle plate 64 may be designed to create a low static pressure when throttle plate 64 is in a partially closed, mostly closed, or fully closed position by forming constricted passages between the edge and the intake conduit 95.

The venturi passage 250 is located within a hollow region 65 of the throttle plate 64 between the first and second openings 230 and 240. Specifically, a first venturi end 252 is directly coupled to the first opening 230 and a second venturi end 254 is directly coupled to the second opening 240. A venturi throat 256 is located between the first venturi end 252 and the second venturi end 254. The first venturi end 252 and second venturi end 254 are shaped such that they both narrow (constrict) toward the venturi throat 256. As such, the venturi throat 256 is a narrowest portion of the venturi passage 250. A connecting passage 258 is fluidly coupled to the venturi throat 256 and the conduit 198.

When engine load decreases and/or when an accelerator pedal moves to a more inclined position, throttle plate 64 may be adjusted by the controller to a more closed position within boost chamber 46. With throttle plate 64 situated in a more closed position, constricted passages may be created between an interior surface of intake conduit 95 and the periphery (edge) of throttle plate 64. In the example of FIG. 2, constricted passages may be created between top edge 242 and the top inside of intake conduit 95, and bottom edge 232 of throttle plate and the bottom inside edge of intake conduit 95. As intake air 82 flows through these constricted passages, a venturi effect is created, and vacuum 84 may be generated within these constricted passages. Specifically, intake airflow velocity may reach a higher value in these constricted passages while local static pressure may reach a lower value producing a vacuum 84 at or near the location of the first and second openings 230 and 240. When the vacuum 84 is applied to the vacuum consumption device, air 86 is drawn from the vacuum consumption device 140 via conduit 198 and connecting passage 258, and then through venturi passage 250 and out of first and second openings 230 and 240 into intake air 82 flowing passed throttle plate 64. Although not shown in the embodiment of FIG. 2, the throttle plate 64 may also provide vacuum to the vacuum consumption device 140 when in a more open position, as will be described below with respect to FIG. 5.

Turning now to FIGS. 3 and 4, they show throttle plate 64 and its arrangement in the intake conduit 95 in more detail. FIG. 3 is a schematic diagram of boost chamber 46 with throttle plate 64 positioned within and viewed from the side of intake conduit 95. FIG. 4 is a cross sectional view of boost chamber 46 within intake conduit 95, in a cross sectional plane along cutting plane M-M' of FIG. 3. In the depicted example, throttle plate 64 is situated within intake conduit 95 and leaning away from the viewer such that bottom edge 232 is lifted towards the viewer. Note that components previously introduced in FIG. 1 and FIG. 2 are numbered similarly in FIGS. 3 and 4, and not reintroduced.

Throttle plate 64 is positioned in the examples of FIG. 3 and FIG. 4 in a more closed position within intake conduit 95 and boost chamber 46. The depicted more closed position enables vacuum generation by flowing intake air 82 through venturi passages formed between the intake conduit 95 and the bottom 232 and top 242 edges. A hollow region 65 is enclosed within walls 67 of throttle plate 64 and first 230 and second 240 openings are located at the edges of throttle plate 64. FIG. 4 depicts the placement of first opening 230 along the bottom edge 232 of throttle plate 64. As shown in FIG. 4, a single, oblong opening is located at the bottom edge 232 of throttle plate 64. A similar opening may be located on top edge 242 of throttle plate 64. Further, the size, location, and number of openings may be different from the example shown herein. Vacuum consumption device 140 is connected via conduit 198, and hollow shaft 74 to opening 68 of throttle plate 64. Hollow shaft 74 may be fluidly coupled to conduit 198 in a longitudinal manner.

A position of throttle plate 64 may be adjusted by motor 81 that is connected to throttle plate 64 via shaft 76. Shaft 76 may not be hollow. Throttle plate 64 may be mounted on hollow shaft 74 and shaft 76 such that shafts 74 and 76 are perpendicular to the edge of the throttle plate 64. Further, throttle plate 64 may be joined to shaft 76 and hollow shaft 74 at its edge via one or more of various joining methods including welding, adhesion, and fastening. Other joining methods not listed herein may also be used. Throttle plate 64 may in turn be fitted within a throttle body (not shown). Each of the shafts, 74 and 76, may be mounted on respective bearings 254 and 258 which may be bolted to their respective housings 255 and 257. Thus, as throttle plate 64 is rotated to different throttle angles within intake conduit 95, shafts 74 and 76 may spin supported by respective bearings 254 and 258. Motor 81 may be powered by a system battery and may receive operating commands from controller 12 to adjust the position of throttle plate 64 via shaft 76 based on engine conditions. In one example, the controller 12 signal the motor 81 to rotate the throttle plate 64 to a more open position in response to an engine load decreasing. By varying a position of shaft 76, motor 81 may adjust an opening and closing of throttle plate 64.

Thus, in one example, throttle plate 64 may be adjusted by motor 81 to a more closed position in response to an increase in vacuum demand at the vacuum consumption device 140. As intake air 82 flows by openings 230 and 240 of throttle plate edges 242 and 232, vacuum may be generated in the respective venturi passages formed between the edges and interior surfaces of the intake conduit 95. This vacuum may be applied to vacuum consumption device 140 by flowing air from vacuum consumption device 140 through conduit 198, via hollow shaft 74 past opening 68 and into hollow region 65 enclosed within throttle plate 64. Air drawn from vacuum consumption device 140 may then be streamed through openings 230 and 240 of hollow throttle plate 64 into intake airflow, e.g. intake air 82, towards the intake valve of cylinder 30.

FIG. 5 illustrates a schematic diagram of an embodiment 500 of the throttle plate 64, coupled to a vacuum consumption device that may be included in the intake of engine 10 of FIG. 1. The embodiment 500 is substantially similar to the embodiment 200, except that the throttle plate 64 is rotated to a more open position. Thus, the throttle plate 64 in the embodiment 500 is angled and/or perpendicular to the throttle plate 64 in the embodiment 200 As such, a greater amount of intake air may flow through the intake conduit 95 in the embodiment 500 compared to the embodiment 200 since the intake conduit 95 is less obstructed in the embodiment 500. In one example, the throttle plate 64 is rotated to a more open position from a more closed position in response to an increased driver demand (e.g., higher engine load, A/C active, driving on an incline, accelerator pedal depressed, etc.).

When driver demand increases, throttle plate 64 may be adjusted by the controller to a more open position within boost chamber 46. With throttle plate 64 situated in a more open position, venturi passage 250 may be positioned to directly receive intake air 82 from the boost chamber 46. In this way, venturi passage 250 is parallel to the x-axis in embodiment 500, while being parallel to the y-axis in embodiment 200 of FIG. 2. As such, the constricted passages of embodiment 200, formed between edges of the throttle plate 64 and the intake conduit 95, are not formed in the embodiment 500. Specifically, venturi passages are not formed between top 242 and bottom 232 edges of the throttle plate. Alternatively, bottom edge 232 and top edge 242 face upstream and downstream directions, respectively, such that intake air 82 may flow uninterruptedly through venturi passage 250. In this way, intake air 82 enters the venturi passage 250 via the first opening 230, flows into the first venturi end 252, then flows into the venturi throat 256, and exits through the second opening 240 via the second venturi end 254. At the venturi throat 256 (e.g., constriction of venturi passage 250), vacuum 84 is generated and supplied to connecting passage 258, which is fluidly coupled to the conduit 198 leading to the vacuum consumption device 140. Specifically, intake airflow velocity may reach a higher value in the venturi throat 256 than in other portions of the venturi passage 250 or intake conduit 95 while local static pressure may reach a lower value producing vacuum 84. When the vacuum 84 is applied to the vacuum consumption device, air 86 is drawn from the vacuum consumption device 140 via conduit 198 and connecting passage 258, and then into the second venturi end 254 when the air 86 may mix with intake air 82 in the venturi passage 250. The mixture then flows out the second opening 240, exiting the throttle plate 64 and entering the boost chamber 46. As such, embodiment 500 shows the throttle plate 64 providing vacuum to the vacuum consumption device 140 in a more open position while embodiment 200 of FIG. 2 shows the throttle plate 64 providing vacuum to the vacuum consumption device in a more closed position. In this way, vacuum may be provided to the vacuum consumption device 140 via the throttle plate 64 independent of the throttle plate position.

Turning now to FIG. 6A, it shows an isometric view of a second embodiment of a throttle plate 600 which may be used in the intake passage 42 or boost chamber 46 of FIG. 1. As such, the throttle plate 600 may be configured to replenish a vacuum of a vacuum consumption device (e.g., vacuum consumption device 140 of FIG. 1) as intake air flows through the intake passage. The throttle plate 600 is substantially disc and/or cylindrically shaped, in one example. A first annular venturi passage 610 is located along a geometric center of the throttle plate 600. A second outer annular venturi passage 620 is located radially outward from and concentric with the first annular venturi passage 610. As such, solid portions of the throttle plate 600, impervious to exhaust gas flow, may be located between the first 610 and second 620 annular venturi passages. This may allow intake air to flow through the throttle plate 600 via the first 610 and second 620 annular venturi passages to an engine (e.g., engine 10 of FIG. 1) without flowing through any other portion of the throttle plate 600. In this way, the vacuum consumption device may be fluidly coupled to one or more of the first 610 and second 620 annular venturi passages and receive vacuum as intake air passes through the venturi passages.

Turning now to FIG. 6B, it shows a face-on view 650 of the throttle plate 600. As shown, a connecting passage 630 extends from the vacuum consumption device, through the second annular venturi passage 620, and to the first annular venturi passage 610. Specifically, the connecting passage 630 is fluidly coupled to venturi throats of the first 610 and second 620 annular venturi passages along a vertical axis 690. In this way, the first 610 and second 620 annular venturi passages are fluidly coupled at respective venturi throats along the vertical axis 690. By doing this, vacuum generated at the venturi throats may be greater than vacuum generated at separate venturi throats. As such, the vacuum provided to the vacuum consumption device by the throttle plate 600 may be greater than vacuum provided to the vacuum consumption device by a single venturi passage.

As shown, the first annular venturi passage 610 is radially interior to the second annular venturi passage 620. In this way, a diameter of the first annular venturi passage 610 is smaller than a diameter of the second annular venturi passage 620. Intake gas does not flow through a portion 602 of the throttle plate 600. Thus, intake gas may deflect off the portion 602 and remain in an intake passage (e.g., boost chamber 46 of FIG. 1).

Turning now to FIG. 6C, it shows a cross-section 675 taken along cutting plane A-A' of FIG. 6B. The throttle plate 600 is shown in a more closed position. In one example, the throttle plate 600 is in a fully closed position, which includes the throttle plate 600 being parallel with the vertical axis 690. As such, a fully open position of the throttle plate 600 may include the throttle plate 600 being parallel to a central axis 695 of an intake conduit 605 (e.g., perpendicular to vertical axis 690). As described above, the fully open position allows more intake air to flow to an engine (e.g., engine 10 of FIG. 1) than the fully closed position. Thus, a more open position may also allow greater intake mass air flow to the engine than a more closed position. As an example, when the throttle plate 600 is in the fully closed position, top 642 and bottom 632 edges are in sealing contact with interior surfaces of the intake conduit 605. This forces intake air 682 to flow through the first 610 and second 620 annular venturi passages before flowing to the engine.

When vacuum consumption device 140 demands vacuum, and engine conditions permit, throttle plate 600 may be adjusted by the controller to a more closed position within intake passage 646 (e.g., boost chamber 46 of FIG. 1. With throttle plate 600 situated in a more closed position, first 610 and second 620 annular venturi passages may be positioned to directly receive intake air 682 from the intake passage 646. Thus, the first 610 and second 620 annular venturi passages are parallel to the central axis 695. Furthermore, bottom edge 632 and top edge 642 are shown pressed against interior surfaces of the intake conduit 605 such that intake air 682 may flow uninterruptedly through first 610 and second 620 annular venturi passages. As such, the throttle plate 600 is shown in a fully closed position where intake air 682 is forced to flow through the first 610 or second 620 annular venturi passages before flowing to the engine. It will be appreciated that intake air 682 may also flow through the first 610 and second 620 annular venturi passages in a more closed position of the throttle plate 600, albeit to a lesser extent than in the fully closed position. As such, the bottom 632 and top 642 edges are not pressed against the interior surfaces of the intake conduit 605 and the throttle plate 600 is angled relative to the vertical axis 690. As such, a portion of intake air may flow between the edges and the intake conduit while a different portion flows through the annular venturi passages when the throttle plate is in the more closed position.

In one example, more vacuum is generated in the fully closed position than in any other positions of the throttle plate 600. In this way, intake air 682 enters the first 610 and second 620 annular venturi passages via the first annular opening 612 and second annular opening 622, respectively. At first and second venturi throats 616 and 626 of the first 610 and second 620 annular venturi passages (e.g., constriction of the venturi passages along the vertical axis 690), respectively, vacuum 684 is generated and supplied to connecting passage 630, which is fluidly coupled to the vacuum consumption device 140. Additionally, the connecting passage 630 fluidly connects the first 610 and second 620 annular venturi passages such that vacuum generated in the first annular venturi passage 610 may be provided to the second annular venturi passage 620 and vice-versa. When the vacuum 684 is applied to the vacuum consumption device 140, air 686 is drawn from the vacuum consumption device 140 via connecting passage 630, and then into the first 610 and/or second 620 annular venturi passages where the air 86 may mix with intake air 82. The mixture then flows out the first 610 and second 620 annular venturi passages via first venturi outlet 614 and second venturi outlet 624, respectively, exiting the throttle plate 600 and flowing to the engine downstream of the throttle plate 600. As an example, when driver demand is low and a brake pedal is likely depressed, thereby likely including a condition where brake booster vacuum is being consumed (e.g., engine idle in a driving gear), the throttle plate 600 may be in a fully closed position or more closed position and provide vacuum to the brake booster Turning now to FIG. 7, it shows an example routine 700 that a controller may perform to adjust a throttle plate (herein, also termed throttle) position in response to vacuum demand from a vacuum consumption device coupled to the throttle plate. Instructions for carrying out routine 700 herein may be executed by the controller based on instructions stored on a memory of the controller and in conjunction with signals received from sensors of the engine system, such as the sensors described above with reference to FIG. 1. The controller may employ engine actuators of the engine system to adjust engine operation, according to the methods described below. Additionally, the controller may modify one or more engine operating parameters responsive to the adjusting of the throttle plate in order to maintain engine torque.

At 702, engine operating conditions may be determined. Engine operating conditions may include engine speed, torque demand, combustion air-fuel ratio, boost pressure, manifold absolute pressure, mass airflow, engine temperature, etc. Once engine operating conditions are estimated, at 704, an initial throttle position may be determined and set based on these engine operating conditions. For example, as the operator torque demand increases, the throttle may be moved to a more open position to increase intake airflow. As another example, if combustion air-fuel ratio is determined to be leaner than a desired stoichiometric value, the throttle may be set to a more closed position to reduce intake airflow. In yet another example, if engine idling conditions are met, the throttle may be moved to a fully closed position. Alternatively, if high engine load conditions are met, the throttle may be moved to a fully open position.

At 706, routine 700 may determine if vacuum is desired by a vacuum consumption device coupled to the throttle. In one example, vacuum may be demanded when the vacuum consumption device is actuated. In another example, if the vacuum consumption device includes a vacuum reservoir, it may be determined if the vacuum requirement of the device exceeds the vacuum available in the reservoir. If it is determined that vacuum is not desired, at 712, the initial throttle position may be maintained and the routine ends. The throttle position may then continue to be adjusted based on engine operating conditions only, and not based on vacuum requirement of the vacuum consumption device.

On the other hand, if it is determined that the vacuum consumption device desires vacuum assistance, at 708, routine 700 may assess whether engine conditions allow a change in throttle position. In particular, it may be determined if the engine conditions permit a change in the throttle position towards a more closed position where intake airflow to the engine is reduced. As such, there may be engine conditions where changes in throttle position may be tolerated without affecting engine performance. In addition, there may be conditions where the throttle position is limited or constrained. For example, if the vehicle is accelerating on a highway and engine speed is higher than a threshold, the throttle may be positioned in a mostly open or fully open position to allow higher airflow. In this situation, the throttle position may not be moved to a more closed position for generating vacuum as it would adversely affect engine torque output and performance. Thus, if it determined that the position of the throttle cannot be adjusted, at 710, the controller maintains the throttle at its initial position and the routine ends. The throttle position may then continue to be adjusted based on engine operating conditions only, and not based on the vacuum requirement of the vacuum consumption device.

However, if it is assessed that engine conditions permit a change in throttle position, and more specifically the conditions permit a decrease in throttle position, at 714, the throttle may be moved towards a more closed position than the initial position. The adjustment to the position of the throttle may depend on the level of vacuum desired by the vacuum consumption device. For example, if a higher level of vacuum is desired, the throttle may be moved further towards a fully closed position (e.g., the throttle may be fully closed). On the other hand, if a lower level of vacuum is desired, the controller may adjust the throttle to a slightly closed or partially closed position. Thus, as the level of desired vacuum from the vacuum consumption device increases, the throttle may be moved towards a more closed position. In one example, if it is determined at 708 that the throttle is already in a closed position during engine idling, the throttle position may be retained, at 714, without further adjustments.

In some examples, the throttle plate may be moved to a more closed or a more open position in response to the demand for vacuum. When in the more open position, intake air flows through a venturi passage of the throttle plate where vacuum is generated and provided to the vacuum consumption device. When in the more closed position, intake air flow through venturi passages between edges of the throttle plate and the intake conduit, where vacuum is generated and provided to the vacuum consumption device.

Next, at 716, vacuum may be generated at the throttle plate as intake air flows through venturi passages of the throttle plate. As elaborated previously, a venturi effect may be created by the flow of intake air through a constriction of a venturi passage in the throttle plate. At 718, the generated vacuum may be applied to the vacuum consumption device to enable the device to be actuated or operated. For example, where the vacuum consumption device is a brake booster, the generated vacuum may be applied to enable wheel braking. As another example, where the vacuum consumption device is a fuel vapor canister, the generated vacuum may be applied to enable canister purging to the engine intake. As yet another example, where the vacuum consumption device is a vacuum actuated valve, the generated vacuum may be applied to enable valve actuation. As vacuum is applied to the vacuum consumption device, air is received from the vacuum consumption device at the throttle plate. As described earlier, air may flow from the vacuum consumption device, through a conduit coupled to a hollow shaft of the throttle plate and out through a venturi outlet of the venturi passage of the throttle plate. Thus, the air from the vacuum consumption device is received at the throttle, facilitating air flow control.

At 720, one or both of fuel injection amount and injection timing may be adjusted based on the throttle position, and existing airflow, to maintain engine torque. Existing airflow may be a combination of fresh intake air that flows past the perforated edge of the throttle and air flowing from the vacuum consumption device through the throttle plate into the intake. In one example, the fuel injection amount and/or timing may be adjusted to maintain a cylinder air-fuel ratio at or close to a desired ratio, such as stoichiometry. In another example, fuel injection amount and/or timing may be modified to maintain engine combustion for torque. In yet another example, one or both of fuel injection timing and fuel injection amount may be varied to maintain each of engine torque and a stoichiometric air fuel ratio.

In one example, during engine idling conditions, as the throttle is adjusted to a fully closed position, airflow via the throttle is reduced while airflow from the vacuum consumption device into the intake manifold is increased. Based on the total airflow being smaller, a fuel injection amount may be decreased to maintain air-fuel ratio. The fuel injection amount may be reduced by decreasing a pulse width of the fuel injection. Further, fuel injection timing may be advanced or retarded based on engine torque requirement.

At 722, one or more engine operating parameters may be varied in response to the adjustment of throttle position and the flowing of air from the vacuum consumption device. Engine operating parameters may be modified to maintain engine torque output. For example, boost pressure may be increased at 724 as the throttle plate is moved to a more closed position at 714. To increase boost pressure, a wastegate coupled across an exhaust turbine may be adjusted to a less open position to allow a larger quantity of exhaust gases to flow past the exhaust turbine. By increasing boost pressure in the boost chamber within the intake, a drop in engine torque resulting from the throttle closing can be compensated for.

Engine torque output may also be maintained by decreasing a rate of exhaust gas recirculation (EGR) at 726. As the throttle is moved to a more closed position, an EGR valve in an EGR passage coupling the engine exhaust to the engine intake may be adjusted to a more closed position to allow a smaller proportion of exhaust gases to be recirculated into the intake. Thus, by reducing the flow of exhaust residuals into the intake, engine dilution is reduced, and the aircharge within engine cylinders may comprise a larger proportion of fresh intake air allowing the engine to maintain its torque output.

At 728, valve timing may be adjusted to retain engine torque levels. In one example, the intake valve may be held open for a longer duration to allow more fresh air into the cylinder. In another example, exhaust valve timing may be modified to reduce the proportion of internal EGR within the cylinder. Further still, each of intake and exhaust valve timing may be adjusted to vary an amount of valve overlap. For example, valve overlap may be reduced to improve engine torque output.

It will be appreciated that the controller may select one or more of the various engine operating parameters described above to maintain torque based on existing operating conditions. For example, during a first condition, where the vehicle is operating under steady state driving conditions when the throttle position is modified to generate vacuum, the controller may only increase boost pressure but not reduce EGR to maintain engine torque output. During a second condition, as the throttle is closed, boost pressure may be maintained while EGR dilution is reduced. In another example, during a third condition, each of internal and external EGR reduction may be used. For example, an exhaust valve may be closed relatively early to reduce internal EGR within the cylinder and an opening of the EGR valve for external EGR may be decreased simultaneously to reduce external EGR into the intake. During a fourth condition, as the throttle position is closed, the controller may reduce EGR while also increasing boost pressure. Still other combinations may be possible.

Next at 730, routine 700 may confirm that sufficient vacuum has been generated to meet the demand of the vacuum consumption device. If it is determined that the demand has not been met, at 734, the throttle position set at 714 may be maintained and vacuum may continue to be generated for a longer duration. In another example, if the throttle is not fully closed at 714, the throttle may be moved to a fully closed position to generate more vacuum, if engine operating conditions allow this adjustment. Routine 700 may then return to 730 to determine if vacuum demand has been met.

If it is determined that sufficient vacuum has been generated for the vacuum consumption device, at 732, the throttle may be adjusted back to its initial position. Alternatively, the throttle may be moved to a position based only on the existing engine operating conditions.

In this way, the throttle valve may be actuated independent of the vacuum demand from the vacuum consumption device, while still providing vacuum to the vacuum consumption device. Additionally or alternatively, the throttle valve may be moved to positions that provide more vacuum to the vacuum consumption device in response to vacuum demand from the vacuum consumption device. In this way, the functions of an aspirator may be combined with those of a throttle enabling a reduction in packaging space. The technical effect of removing the need for a separate aspirator is to decrease packaging constraints and reduce costs. The throttle described above provides vacuum to the vacuum consumption device through a plurality of rotational positions. This may be achieved by a venturi passage located inside the throttle plate configured to receive intake air and generate vacuum. The throttle plate may apply the vacuum to the vacuum consumption device to replenish its vacuum.

A system comprising a throttle valve having a venturi passage located inside its throttle body, the venturi passage configured to receive intake air directly from an intake passage when the venturi passage is parallel to a direction of incoming intake air flow. A first example of the system further comprising where the throttle valve is beveled at top and bottom edges, the edges forming venturi passages outside the throttle body between the throttle body and an intake conduit. A second example of the system, optionally including the first example, further includes where the top and bottom edges comprise openings located at extreme ends of the venturi passage inside the throttle body. A third example of the system, optionally the first and/or second examples, further includes where the venturi passages between the throttle body and the intake conduit are formed when the throttle body is in a more closed position, and where the venturi passage inside the throttle body is parallel to the direction of incoming intake air flow when the throttle body is in a more open position, and where the more closed position allows less intake air to flow to an engine than the more open position. A fourth example of the system, optionally including one or more of the first through third examples, further includes where the venturi passage is a first annular venturi passage located interior to a second annular venturi passage, the first annular venturi passage located on a geometric center of the throttle body and the second annular venturi passage located between an edge of the throttle body and the first annular venturi passage. A fifth example of the system, optionally including one or more of the first through fourth examples, further includes where the first annular venturi passage is fluidly coupled to the second annular venturi passage via a connecting passage located along a vertical axis. A sixth example of the system, optionally including one or more of the first through fifth examples, further includes where the first and second annular venturi passages are concentric about the direction of incoming intake air flow. A seventh example of the system, optionally including one or more of the first through sixth examples, further includes where the first and second annular venturi passages are parallel to the direction of incoming intake air flow when the throttle body is in a closed position. An eighth example of the system, optionally including one or more of the first through seventh examples, further includes where the closed position includes edges of the throttle body being pressed against interior surfaces of an intake conduit preventing intake air from flowing therethrough.

A system comprising an engine including an intake, a throttle plate mounted on a hollow shaft positioned in the intake, the throttle plate having a first opening located on its circumference and a second opening located on its circumference diametrically opposite the first opening, and a venturi passage located inside the throttle plate between the first and second openings, and a controller with computer-readable instructions stored in non-transitory memory for in response to engine operations, adjusting a position of the throttle plate to adjust intake air flow while generating vacuum through the adjusting of the throttle plate as intake air flows through the venturi passage or through constricted passages formed between the intake and the first and second openings. A first example of the system further includes where a vacuum consumption device, wherein the hollow shaft of the throttle plate is fluidly coupled to the vacuum consumption device and a throat of the venturi passage in the throttle plate. A second example of the system, optionally including the first example, further includes where the vacuum consumption device is one of a brake booster, a fuel vapor canister, and a vacuum actuated valve. A third example of the system, optionally including the first and second examples, further includes where the first opening faces an upstream direction and the second opening faces a downstream direction relative to a direction of incoming intake air flow when the throttle plate is in a more open position, and where intake air enters the venturi passage via the first opening and exits the venturi passage via the second opening. A fourth example of the system, optionally including one or more of the first through third examples, further includes where the first opening and second opening face an interior surface of an intake conduit of the intake when the throttle plate is in a more closed position, and where intake air flows through constricted passages located between the intake conduit and the first and second openings. A fifth example of the system, optionally including one or more of the first through fourth examples, further includes where the venturi passage narrows between the first and second openings toward a venturi throat such that the venturi throat is a narrowest portion of the venturi passage. A sixth examples of the system, optionally including one or more of the first through fifth examples, further includes where a shaft fluidly coupled to the venturi throat such that a vacuum generated at the venturi throat is provided to a vacuum consumption device through the shaft.

A system comprising a throttle body located along an intake conduit configured to receive intake air via a first venturi passage or a second venturi passage located inside the throttle body, and where edges of the throttle body are sealed with interior surfaces of the intake conduit in a closed position. A first example of the system further includes where the first venturi passage and second venturi passage are annular, and where the first venturi passage is located along a geometric center of the throttle body and is interior to the second venturi passage. A second example of the system, optionally including the first example, further includes where intake air only flows by the throttle body by flowing through the first and second venturi passages when the throttle body is in the closed position, and where intake air flows through an opening formed between the intake conduit and throttle body when the throttle body is in an open position. A third example of the system, optionally including the first and/or second examples, further includes where the first venturi passage and the second venturi passage are fluidly coupled via a connecting passage, the connecting passage being further coupled to a vacuum consumption device.

An alternate embodiment includes a method comprising adjusting a position of a throttle plate comprising two openings with a venturi passage located therebetween and generating vacuum via intake airflow passing through the venturi passage in the throttle plate. The throttle plate may apply the generated vacuum to a vacuum consumption device fluidly coupled to the throttle plate via a hollow shaft, the vacuum consumption device including a brake booster. In one example, rotation of the throttle plate may create two constricted passages between an intake conduit and top and bottom edges of the throttle plate when the throttle plate is in a more closed position. The more closed position including flowing less intake air to an engine. The two openings include a first opening and a second opening, the first opening located at the bottom edge and the second opening located at the top edge, and where the first and second openings are fluidly coupled to a most constricted portion of the constricted passages, respectively. Adjusting the throttle body includes adjusting includes rotating the throttle plate to a more open position and flowing intake air through the venturi passage inside the throttle plate, the more open position includes flowing more intake air to an engine, and where the adjusting further includes rotating the throttle plate to a more closed position and flowing intake air through two constricting passages located diametrically opposite one another between the throttle plate and the intake conduit. The more open position further includes generating vacuum inside the throttle plate and where the more closed position further includes generating vacuum outside the throttle plate. Passing intake airflow through the venturi passage of the throttle plate includes flowing more air through the venturi passage of the throttle plate when the throttle plate is in a more open position. The method includes flowing more intake air through an intake passage when the throttle plate is moved to a more open position, and where adjusting the position of the throttle plate includes flowing less intake air through the intake passage when the throttle plate is moved to a more closed position.

Another alternate embodiment includes a method, comprising connecting a vacuum consumption device to a venturi throat of a venturi passage located inside a throttle plate positioned in an intake passage, a circumference of the throttle plate configured with first and second openings located at opposite ends of the venturi passage, flowing intake air through the venturi passage of the throttle plate when the throttle plate is in a more open position, and flowing intake air through constricting passages located adjacent to the first and second openings when the throttle plate is in a more closed position. The method further comprising generating a vacuum in one or more of the venturi throat and constricting passages and flowing the vacuum to the vacuum consumption device. The method further includes where flowing vacuum to the vacuum consumption device further includes flowing air from the vacuum consumption device to the venturi passage inside the throttle plate, and where the air from the vacuum consumption device exits the venturi passage and enters the intake passage. The venturi passage of the throttle plate is parallel to the intake passage when the throttle plate is in a fully open position, and where the venturi passage of the throttle plate is perpendicular to the intake passage when the throttle plate is in a fully closed position.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system comprising:

a throttle valve having a venturi passage located inside its throttle body, the venturi passage configured to receive intake air directly from an intake passage when the venturi passage is parallel to a direction of incoming intake air flow, the venturi passage being a first annular venturi passage located interior to a second annular venturi passage, the first annular venturi passage located on a geometric center of the throttle body and the second annular venturi passage located between an edge of the throttle body and the first annular venturi passage.

2. The system of claim 1, wherein the throttle valve is beveled at top and bottom edges, the edges forming venturi passages outside the throttle body between the throttle body and an intake conduit.

3. The system of claim 2, wherein the top and bottom edges comprise openings located at extreme ends of the venturi passage inside the throttle body.

4. The system of claim 2, wherein the venturi passages between the throttle body and the intake conduit are formed when the throttle body is in a more closed position, and where the venturi passage inside the throttle body is parallel to the direction of incoming intake air flow when the throttle body is in a more open position, and where the more closed position allows less intake air to flow to an engine than the more open position.

5. The system of claim 1, wherein the first annular venturi passage is fluidly coupled to the second annular venturi passage via a connecting passage located along a vertical axis.

6. The system of claim 1, wherein the first and second annular venturi passages are concentric about the direction of incoming intake air flow.

7. The system of claim 1, wherein the first and second annular venturi passages are parallel to the direction of incoming intake air flow when the throttle body is in a closed position.

8. The system of claim 7, wherein the closed position includes edges of the throttle body being pressed against interior surfaces of an intake conduit preventing intake air from flowing therethrough.

9. A system comprising:

an engine including an intake;

a throttle plate mounted on a hollow shaft positioned in the intake, the throttle plate having a first opening located on its circumference and a second opening located on its circumference diametrically opposite the first opening, and a venturi passage located inside the throttle plate between the first and second openings; and a controller with computer-readable instructions stored in non-transitory memory for:

in response to engine operations, adjusting a position of the throttle plate to adjust intake air flow while generating vacuum through the adjusting of the throttle plate as intake air flows through the venturi passage or through constricted passages formed between the intake and the first and second openings.

10. The system of claim 9, further comprising a vacuum consumption device, wherein the hollow shaft of the throttle plate is fluidly coupled to the vacuum consumption device and a throat of the venturi passage in the throttle plate.

11. The system of claim 10, wherein the vacuum consumption device is one of a brake booster, a fuel vapor canister, and a vacuum actuated valve.

12. The system of claim 9, wherein the first opening faces an upstream direction and the second opening faces a downstream direction relative to a direction of incoming intake air flow when the throttle plate is in a more open position, and where intake air enters the venturi passage via the first opening and exits the venturi passage via the second opening.

13. The system of claim 9, wherein the first opening and second opening face an interior surface of an intake conduit of the intake when the throttle plate is in a more closed position, and where intake air flows through constricted passages located between the intake conduit and the first and second openings.

14. The system of claim 9, wherein the venturi passage narrows between the first and second openings toward a venturi throat such that the venturi throat is a narrowest portion of the venturi passage.

15. The system of claim 14, further comprising a shaft fluidly coupled to the venturi throat such that a vacuum generated at the venturi throat is provided to a vacuum consumption device through the shaft.

16. A system comprising:

a throttle body located along an intake conduit configured to receive intake air via first and second annular venturi passages each located inside the throttle body whose edges are sealed with interior surfaces of the intake conduit in a closed position, the first passage located interior to the second passage and on a geometric center of the throttle body, the second passage located between a throttle body edge and the first passage.

17. The system of claim 16, wherein the first venturi passage and second venturi passage are annular, and where the first venturi passage is located along the geometric center of the throttle body and is interior to the second venturi passage.

18. The system of claim 16, wherein intake air only flows by the throttle body by flowing through the first and second venturi passages when the throttle body is in the closed position, and where intake air flows through an opening formed between the intake conduit and throttle body when the throttle body is in an open position.

19. The system of claim 16, wherein the first venturi passage and the second venturi passage are fluidly coupled via a connecting passage, the connecting passage being further coupled to a vacuum consumption device.

* * * * *